US008094080B2

(12) United States Patent
Komura

(10) Patent No.: US 8,094,080 B2
(45) Date of Patent: Jan. 10, 2012

(54) ANTENNA AND RADIO COMMUNICATION APPARATUS

(75) Inventor: Ryo Komura, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 340 days.

(21) Appl. No.: 12/542,731

(22) Filed: Aug. 18, 2009

(65) Prior Publication Data

US 2009/0295653 A1 Dec. 3, 2009

Related U.S. Application Data

(63) Continuation of application No. PCT/JP2008/051506, filed on Jan. 31, 2008.

(30) Foreign Application Priority Data

Mar. 23, 2007 (JP) ..... 2007-076659

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

| | | | | |
|---|---|---|---|---|
| 5,748,149 | A | 5/1998 | Kawahata | |
| 5,903,240 | A | 5/1999 | Kawahata et al. | |
| 6,614,398 | B2 * | 9/2003 | Kushihi et al. | 343/700 MS |
| 6,873,299 | B2 | 3/2005 | Dakeya et al. | |
| 7,119,749 | B2 * | 10/2006 | Miyata et al. | 343/702 |
| 7,161,536 | B2 | 1/2007 | Hilgers | |
| 2002/0126049 | A1 | 9/2002 | Okabe et al. | |
| 2002/0190907 | A1 * | 12/2002 | Konishi et al. | 343/702 |
| 2003/0071757 | A1 | 4/2003 | Yamaki | |
| 2004/0085245 | A1 | 5/2004 | Miyata et al. | |
| 2005/0243001 | A1 | 11/2005 | Miyata et al. | |
| 2007/0257850 | A1 | 11/2007 | Onaka et al. | |
| 2009/0303144 | A1 * | 12/2009 | Hirano | 343/750 |

FOREIGN PATENT DOCUMENTS

| | | | |
|---|---|---|---|
| DE | 696 04 145 | T2 | 2/2000 |
| DE | 697 15 698 | T2 | 5/2003 |
| DE | 102 47 297 | A1 | 4/2004 |
| EP | 1 267 441 | A2 | 12/2002 |
| EP | 1 453 139 | A1 | 9/2004 |
| EP | 1 505 689 | A1 | 2/2005 |

(Continued)

OTHER PUBLICATIONS

Official Communication issued in International Patent Application No. PCT/JP2008/051506, mailed on Apr. 8, 2008.

(Continued)

*Primary Examiner* — Dieu H Duong
(74) *Attorney, Agent, or Firm* — Keating & Bennett, LLP

(57) ABSTRACT

An antenna includes linear electrodes disposed on a surface of a substrate. A surface-mount antenna element including a capacitor is disposed in a non-ground region of a mount board. The capacitor is arranged such that portions of at least one of two linear electrodes face each other with a predetermined distance therebetween. The non-ground region includes a first radiation electrode and linear electrode portions of a second radiation electrode. The linear electrodes of the surface-mount antenna element are individually connected to the radiation electrodes. A chip reactive element is disposed at the first radiation electrode and the linear electrode portions of the second radiation electrode as appropriate.

12 Claims, 16 Drawing Sheets

FOREIGN PATENT DOCUMENTS

| | | | |
|---|---|---|---|
| JP | 11-004113 | A | 1/1999 |
| JP | 11-027026 | A | 1/1999 |
| JP | 2002-271129 | A | 9/2002 |
| JP | 2002-335117 | A | 11/2002 |
| JP | 2003-051705 | A | 2/2003 |
| JP | 2003-133844 | A | 5/2003 |
| JP | 2003-142936 | A | 5/2003 |
| JP | 2004-112028 | A | 4/2004 |
| JP | 2004-166242 | A | 6/2004 |
| JP | 2005-318336 | A | 11/2005 |
| JP | 2006-203446 | A | 8/2006 |
| WO | 2006/077714 | A1 | 7/2006 |

OTHER PUBLICATIONS

Official Communication issued in corresponding German Patent Application No. 11 2008 000 578.8, mailed on Aug. 12, 2011.

* cited by examiner

ANTENNA AND RADIO COMMUNICATION APPARATUS

BACKGROUND OF THE INVENTION

1. Field of the Invention

The present invention relates to an antenna for use in a radio communication apparatus such as a mobile communication apparatus and a radio communication apparatus including the antenna.

2. Description of the Related Art

From the viewpoint that miniaturization and frequency adjustment can be easily achieved, surface-mount antennas are often used for radio communication apparatuses such as terminal units (mobile telephones) for use in a mobile telephone system. In such a general surface-mount antenna in the related art, a radiation electrode is provided on a surface of a dielectric substrate to form an inductor, and an open end of the radiation electrode is spaced from a feed electrode to form a capacitor. Thus, an LC resonance circuit is provided.

In recent years, as disclosed in Japanese Unexamined Patent Application Publication No. 2005-318336, in accordance with the increase in the number of functions of mobile communication apparatuses such as mobile telephones, surface-mount antennas with improved antenna efficiency and a wider bandwidth which are capable of performing multiband communication have been proposed.

FIG. 1 is a perspective view illustrating a configuration of an antenna disclosed in Japanese Unexamined Patent Application Publication No. 2005-318336. An antenna 1 is disposed in a corner of a mount board 201 of a radio communication apparatus such as a mobile telephone. In a non-ground region 201*a* (a region where a ground electrode 201*b* is not formed) in the corner of the mount board 201, a parallel radiation electrode pattern 3 and a surface-mount antenna component 4 are provided. Using the parallel radiation electrode pattern 3 and the surface-mount antenna component 4, a parallel resonance circuit 2 is formed in the non-ground region 201*a*. A high-frequency current is supplied from a feeding point 5 to the parallel resonance circuit 2.

The parallel resonance circuit 2 is obtained by connecting the surface-mount antenna component 4 in parallel to the parallel radiation electrode pattern 3 formed in the non-ground region 201*a*. The parallel radiation electrode pattern 3 is provided in the form of a loop to occupy most of the non-ground region 201*a* and is open at a bottom of the surface mount antenna component 4. Thus, the parallel radiation electrode pattern 3 of the parallel resonance circuit 2 forms an inductor L. The inductance of the inductor L can be adjusted in accordance with the length of the parallel radiation electrode pattern 3. The surface-mount antenna component 4 is connected to the parallel radiation electrode pattern 3.

The surface mount antenna component 4 includes a pair of electrodes 41 and 42. The electrodes 41 and 42 are provided on a surface of a rectangular parallelepiped dielectric substrate. A capacitor Cd corresponding to a distance d is formed.

However, in the case of the antenna in the related art illustrated in FIG. 1 in which the surface-mount antenna component functioning as a part of the inductor and the capacitor is connected to the loop radiation electrode pattern formed in the non-ground region of the mount board, it is impossible to set a resonance frequency of the antenna to a desired low value because an area required for the parallel resonance circuit is large.

Accordingly, it is necessary to set an inductance value of the inductor L1, which affects the resonance frequency of the antenna in the matching circuit composed of the inductors L0 and L1 illustrated in FIG. 1, to a large value. As a result, a larger loss occurs in the matching circuit. If the non-ground region 201*a* becomes larger and the path length of the parallel radiation electrode pattern 3 becomes longer, an antenna having a desired low resonance frequency can be implemented. However, this leads to the increase in the size of the antenna.

SUMMARY OF THE INVENTION

In view of the above-described problems, preferred embodiments of the present invention provide an antenna capable of setting a resonance frequency to a desired low frequency without increasing the size of the antenna and increasing a circuit loss, and a radio communication apparatus including the antenna.

An antenna according to a preferred embodiment of the present invention includes a mount board having a non-ground region, and a surface-mount antenna element disposed in the non-ground region. The surface-mount antenna element includes at least two linear electrodes that are parallel or substantially parallel to each other on a surface of a substrate, and at least one capacitor arranged such that portions of at least one of the two linear electrodes face each other with a predetermined distance therebetween. The non-ground region of the mount board includes radiation electrodes that are individually connected to the two linear electrodes to define inductors, and one of the radiation electrodes includes a feeding point. The two linear electrodes of the surface-mount antenna element, the capacitor, and the radiation electrodes define a parallel resonance circuit.

Chip reactive elements may preferably be individually connected in series to the radiation electrodes in the non-ground region.

Each of the radiation electrodes preferably may include two linear electrode portions that are parallel or substantially parallel to each other. A chip reactive element preferably may be used to connect predetermined positions of the two linear electrode portions in the non-ground region.

The radiation electrodes may preferably be a first radiation electrode connected to first ends of the two linear electrodes of the surface-mount antenna element and a second radiation electrode connected to second ends of the two linear electrodes of the surface-mount antenna. The first radiation electrode may preferably include the feeding point.

The reactive elements preferably may be individually connected to the first radiation electrode and the second radiation electrode.

The first radiation electrode connected to the first ends of the two linear electrodes of the surface-mount antenna may preferably include the feeding point. An auxiliary electrode may preferably branch off and extend from the second radiation electrode connected to the second ends of the two linear electrodes and extend.

One end of a branch electrode plate may preferably be connected to the second radiation electrode.

The auxiliary electrode preferably may branch off and extend from one of the two linear electrodes of the surface-mount antenna element.

Portions of the radiation electrodes may preferably be disposed on an undersurface of the mount board on which the surface-mount antenna element is disposed.

Each of the radiation electrodes preferably may include two linear electrode portions that are parallel or substantially parallel to each other. A radiation electrode plate may preferably be used to connect the two linear electrode portions.

One of the radiation electrodes preferably may be connected to the first ends of the two linear electrodes of the surface-mount antenna element. The other one of the radiation electrodes may preferably be used to extend the second ends of the two linear electrodes of the surface-mount antenna element from an upper surface of the surface-mount antenna element to a lower surface (surface on which the surface-mount antenna element is disposed) of the surface-mount antenna element.

A radio communication apparatus according to another preferred embodiment of the present invention includes an antenna having a configuration according to any of the preferred embodiments of the present invention described above. A radio communication circuit is preferably provided on a mount board.

According to the above-described configurations, the following advantages can be obtained.

The non-ground region of the mount board preferably includes radiation electrodes that are individually connected to the two linear electrodes of the surface-mount antenna element to define inductors. The two linear electrodes of the surface-mount antenna element, the capacitor, and the radiation electrodes define a parallel resonance circuit. Accordingly, by increasing the dielectric constant of the substrate of the surface-mount antenna element, a resonance frequency can be set to a low value even if the length of the radiation electrode on the mount board is short. The increase in the area required for the antenna on the mount board can therefore be prevented. In this case, since it is not required to set an inductance value to a large value in the matching circuit, the occurrence of a large circuit loss can be prevented.

Chip reactive elements preferably may be individually connected in series to the radiation electrodes in the non-ground region of the mount board. As a result, the reactance of each of the radiation electrodes can be adjusted, and a desired resonance frequency can be set.

Each of the radiation electrodes may preferably include two linear electrode portions that are parallel or substantially parallel to each other. A chip reactive element may preferably be used to connect predetermined positions of the two linear electrode portions. As a result, the reactance of each of the radiation electrodes can be adjusted without changing an electrode pattern on the mount board and the design of the surface-mount antenna element, and a desired resonance frequency characteristic can be obtained.

The radiation electrodes preferably may include a first radiation electrode connected to the first ends of the two linear electrodes of the surface-mount antenna element and a second radiation electrode connected to the second ends of the two linear electrodes of the surface-mount antenna. The first radiation electrode may preferably include the feeding point. As a result, two paths from the feeding point to the capacitor can be generated, and two or three resonance frequencies can be switched in accordance with a frequency used. That is, an antenna capable of performing multiband communication can be implemented.

The reactive elements may preferably be individually connected to the first radiation electrode and the second radiation electrode. As a result, a plurality of resonance frequencies can be separately adjusted.

An auxiliary electrode preferably may branch off from the second radiation electrode and extend in the non-ground region. As a result, a radiation resistance of the antenna is increased, and antenna efficiency can be improved.

One end of a branch electrode plate may preferably be connected to the second radiation electrode, and the branch electrode plate may preferably be disposed in space. As a result, a radiation resistance of the antenna is increased, and antenna efficiency is improved.

The auxiliary electrode may preferably branch off and extend from one of the two linear electrodes of the surface-mount antenna element. As a result, a radiation resistance of the antenna is increased, and antenna efficiency is improved.

Portions of the radiation electrodes may be disposed on an undersurface of the mount board. As a result, an area required for the antenna on the mount board is further reduced.

A radiation electrode plate may be disposed in space as a portion of one of the radiation electrodes. As a result, a three-dimensional structure of the radiation electrode is obtained, and an area required for the antenna on the mount board is reduced.

One of the radiation electrodes may extend to a surface on which the surface-mount antenna element is disposed. As a result, an area required for the antenna on the mount board is reduced.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

An antenna according to the first preferred embodiment and a radio communication apparatus according to the first preferred embodiment will be described with reference to FIGS. 2 to 6.

Figure 1:
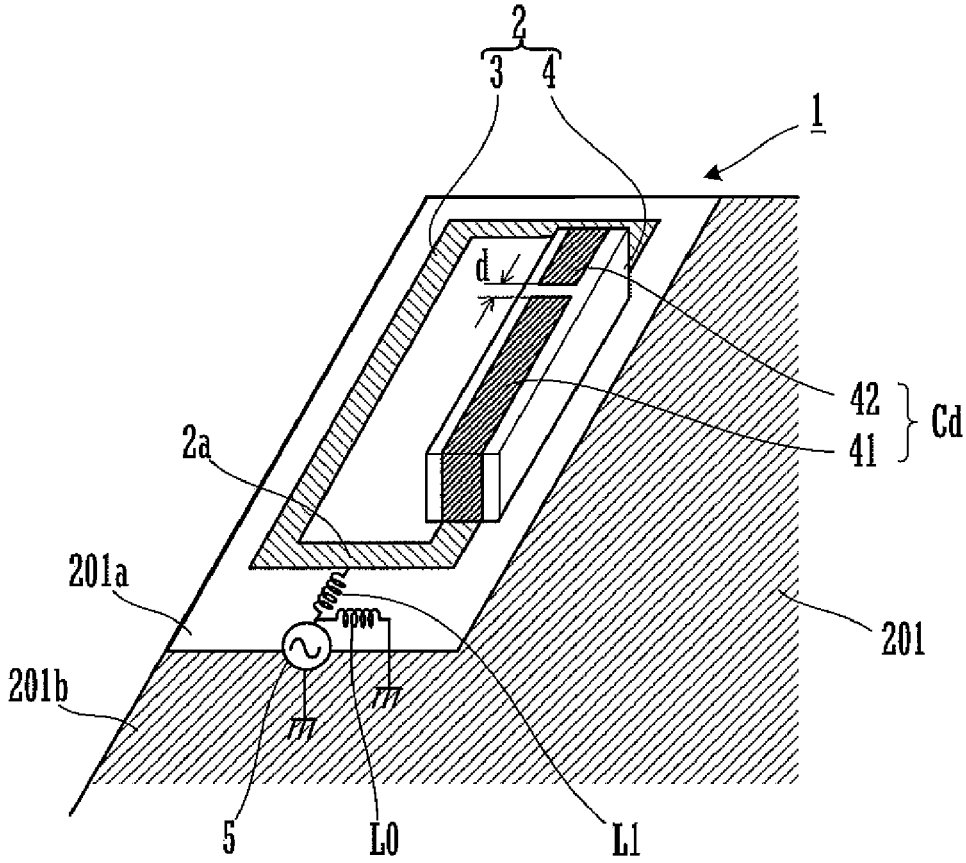
FIG.1 PRIOR ART
FIG. 1 is a perspective view illustrating a configuration of an antenna disclosed in Japanese Unexamined Patent Application Publication No. 2005-318336.
Figure 2:
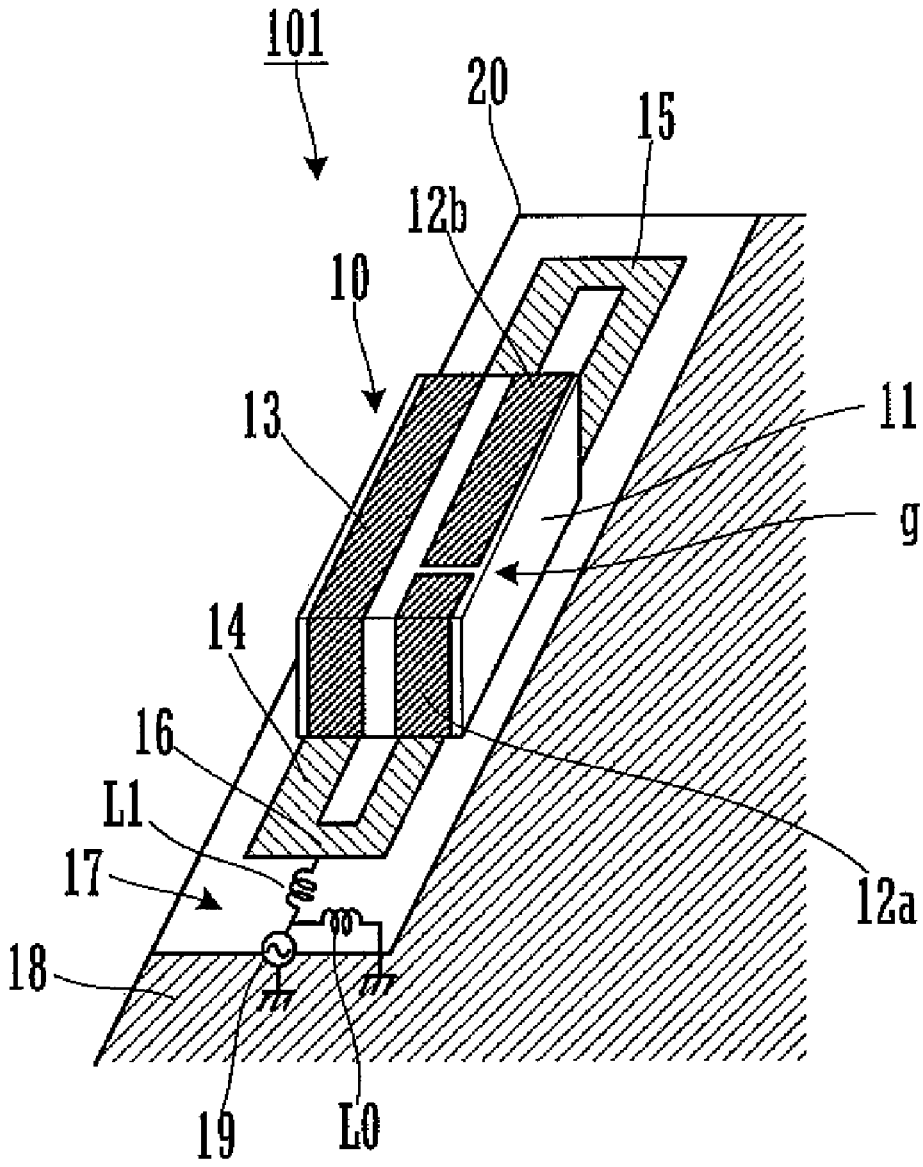
FIG. 2 is a perspective view illustrating a configuration of an antenna according to a first preferred embodiment of the present invention.

FIG. 2 is a perspective view of an antenna according to the first preferred embodiment. As illustrated in FIG. 2, in an antenna 101, a surface-mount antenna element 10 is located on a non-ground region 17 of a mount board 20. The surface-mount antenna element 10 preferably includes two linear electrodes 12 and 13 that are parallel or substantially parallel to each other on the surface of a dielectric substrate 11. Portions of the electrode 12 face each other with a predetermined distance therebetween to define a capacitor g.

In the non-ground region 17 of the mount board 20, a first radiation electrode 14 and a second radiation electrode 15 are provided. Each of the first radiation electrode 14 and the second radiation electrode 15 is connected to the two linear electrodes 12 and 13 to define an inductor. The first radiation electrode 14 is connected to a feeder circuit 19 via a matching circuit including inductors L0 and L1.

The linear electrodes 12 and 13 of the surface-mount antenna element 10, the capacitor g, and the radiation electrodes 14 and 15 define a parallel resonance circuit.

Figure 3:
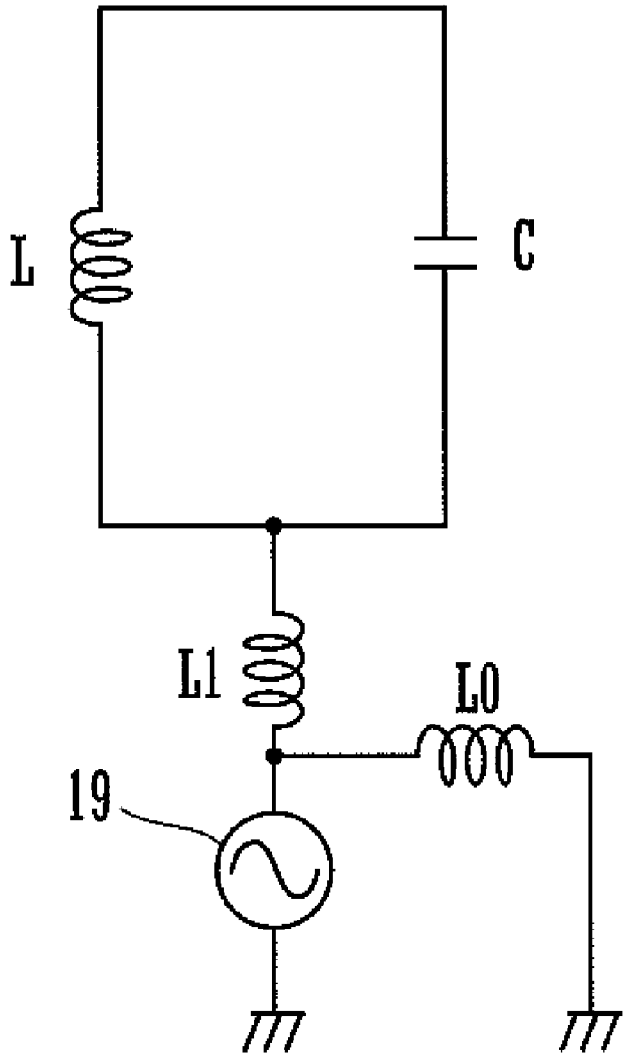
FIG. 3 is a diagram illustrating an equivalent circuit of an antenna according to the first preferred embodiment of the present invention.

FIG. 3 is a diagram illustrating an equivalent circuit of an antenna according to the first preferred embodiment. A parallel resonance circuit including a capacitor C and an inductor L is illustrated. The capacitor C is a lumped-parameter element of a capacitance of the capacitor g. The inductor L is a lumped-parameter element of inductances of the linear electrodes 12 and 13 and the radiation electrodes 14 and 15.

Figure 4:
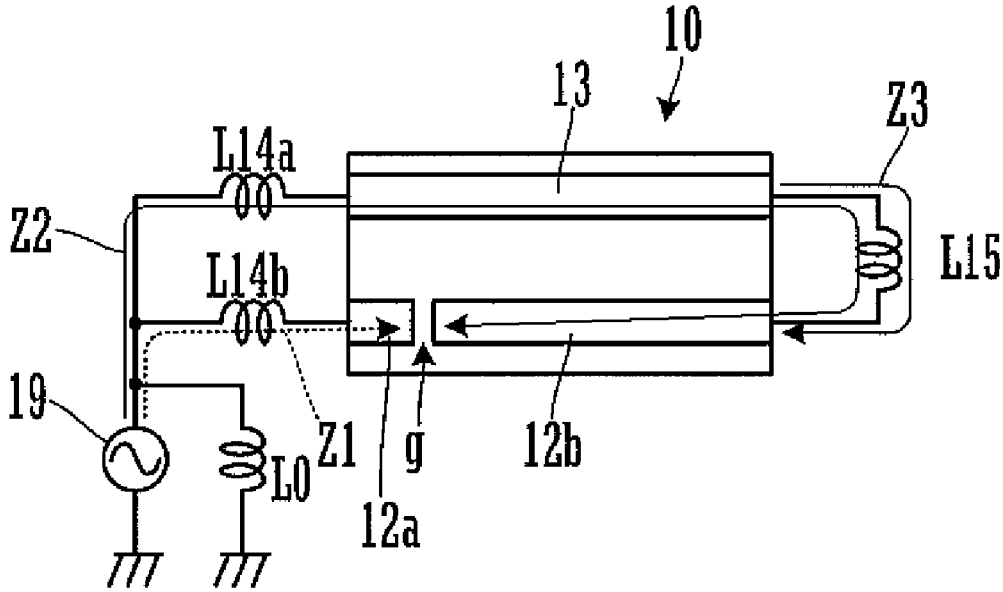
FIG. 4 is a circuit diagram of an antenna according to the first preferred embodiment of the present invention.
Figure 5:
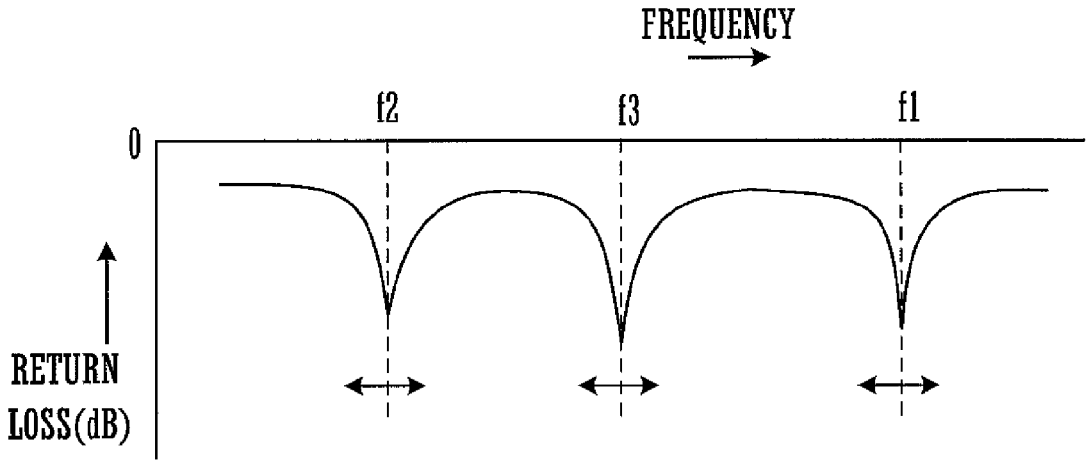
FIG. 5 is a diagram illustrating a frequency characteristic of a return loss of an antenna according to the first preferred embodiment of the present invention.

FIG. 4 is a circuit diagram schematically illustrating a portion of the antenna illustrated in FIG. 2. FIG. 5 is a diagram illustrating a frequency characteristic of a return loss of the antenna illustrated in FIG. 2. Referring to FIG. 4, inductors L14*a* and L14*b* are inductors for the first radiation electrode 14, and an inductor L15 is an inductor for the second radiation electrode 15.

A path Z1 from the feeder circuit 19 via the inductor L14*b* to the capacitor g predominantly defines a resonance frequency f1 illustrated in FIG. 5, a path Z2 from the feeder circuit 19 via the inductor L14*a*, the linear electrode 13, the inductor L15, and a linear electrode 12*b* to the capacitor g predominantly defines a resonance frequency f2 illustrated in FIG. 5, and a path Z3 corresponding to the inductor L15 (the second radiation electrode 15) predominantly defines a resonance frequency f3 illustrated in FIG. 5.

Accordingly, this antenna functions as a multiple resonant antenna having three resonance points, that is, the resonance frequencies f1, f2, and f3. For example, the resonance frequency f1 corresponds to CDMA2000 having a frequency band from 2110 MHz to 2130 MHz, the resonance frequency f2 corresponds to CDMA800 having a frequency band from 843 MHz to 875 MHz, and the resonance frequency f3 corresponds to GPS having a frequency of 1575 MHz. That is, this antenna can be used as an antenna for a mobile telephone that includes a GPS receiver and is compatible with both of CDMA800 and CDMA 2000.

Figure 6:
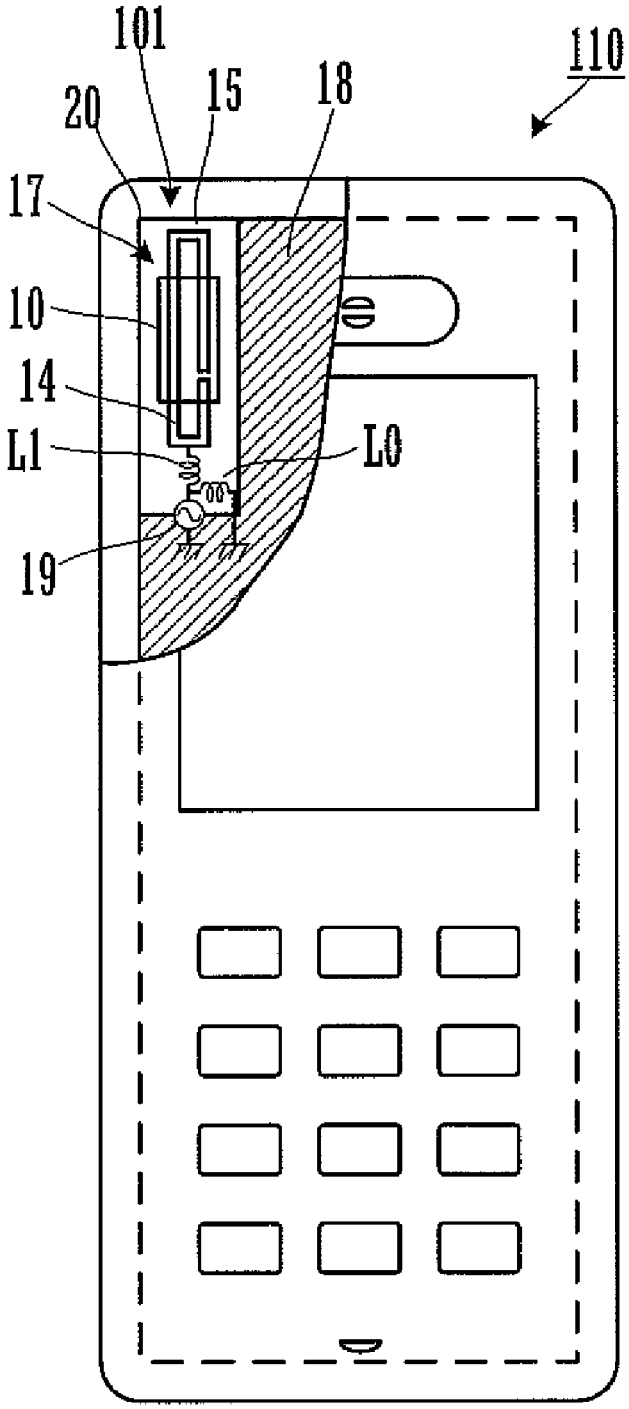
FIG. 6 is a diagram illustrating configurations of an antenna according to the first preferred embodiment and a mobile telephone including the antenna.

FIG. 6 is a schematic elevation view of a mobile telephone including an antenna according to the first preferred embodiment. As illustrated in FIG. 6, the antenna 101 is disposed in an upper corner of the mount board 20 of a mobile telephone 110. In the antenna 101, the surface-mount antenna element 10 is disposed in the non-ground region 17 (a region in which a ground electrode 18 is not formed) in which the first radiation electrode 14 and the second radiation electrode 15 are located. On the mount board 20, the feeder circuit 19 and the inductors L0 and L1 are disposed. The inductors L0 and L1 define a matching circuit for the feeder circuit 19 and the first radiation electrode 14.

Second Preferred Embodiment

Figure 7:
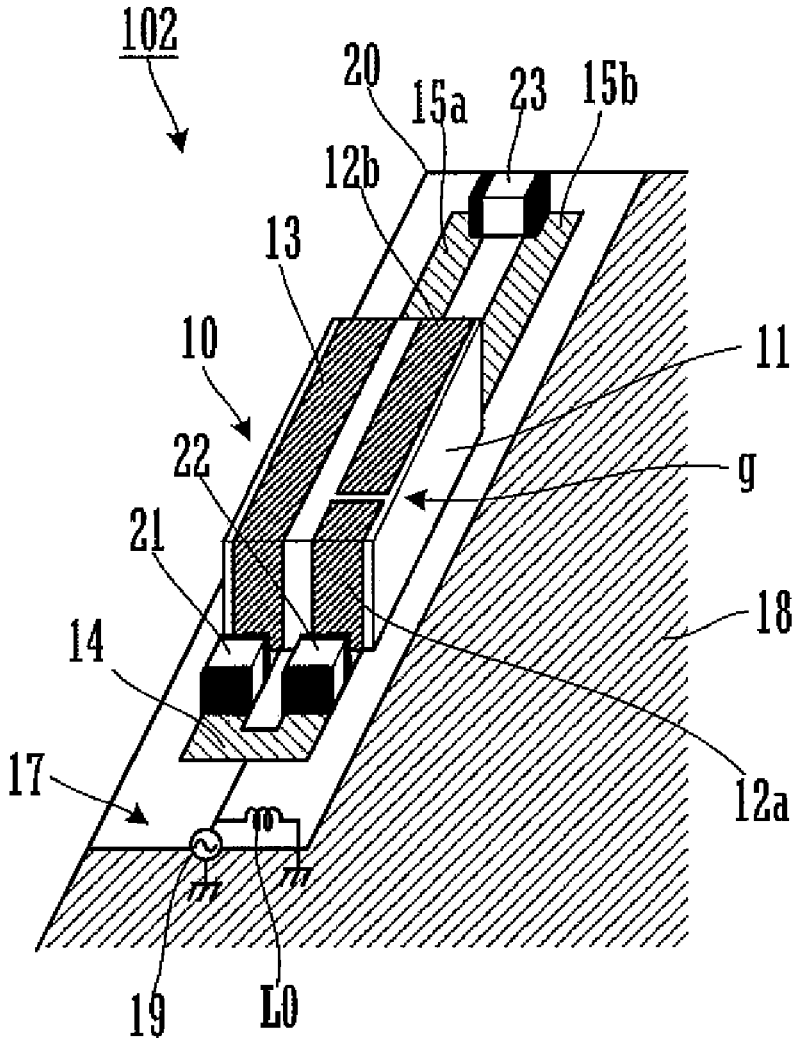
FIG. 7 is a perspective view of an antenna according to a second preferred embodiment of the present invention.

FIG. 7 is a perspective view of an antenna according to the second preferred embodiment. An antenna according to the second preferred embodiment differs from the antenna 101 illustrated in FIG. 2 in that the antenna according to the second preferred embodiment includes chip reactive elements 21, 22, and 23. That is, the reactive elements 21 and 22 are connected in series to the first radiation electrode 14. A second radiation electrode preferably includes two linear electrode portions 15*a* and 15*b* that are parallel or substantially parallel to each other. The reactive element 23 is arranged so that predetermined positions of the linear electrode portions 15*a* and 15*b* are connected to each other.

If chip inductors are used as the reactive elements 21 and 22, these chip inductors are connected in series to the first radiation electrode 14 near the feeder circuit 19. Accordingly, an inductor used for impedance matching between the parallel resonance circuit and the feeder circuit 19 (the inductor L1 illustrated in FIG. 2) can be removed.

If the reactive elements 21 and 22 are chip inductors, the inductances of the inductors L14*a* and L14*b* included in the circuit illustrated in FIG. 4 become larger. As a result, the resonance frequencies f1 and f2 illustrated in FIG. 5 are shifted to lower frequencies. If the reactive element 23 is a chip inductor, the inductance of the inductor L15 illustrated in FIG. 4 becomes larger. As a result, the resonance frequency f3 illustrated in FIG. 5 is shifted to a lower frequency. In contrast, if the reactive elements 21, 22, and 23 are chip capacitors, the resonance frequencies f1, f2, and f3 are shifted to higher frequencies.

If the mounting position of the reactive element 23 is changed, a path through the linear electrode portions 15*a* and 15*b* of the second radiation electrode and the reactive element 23 is changed. As a result, the resonance frequencies f2 and f3 are changed. Accordingly, a resonance frequency can be set to a desired value by changing not only a value of a reactive element but also a mounting position of the reactive element.

Third Preferred Embodiment

Figure 8:
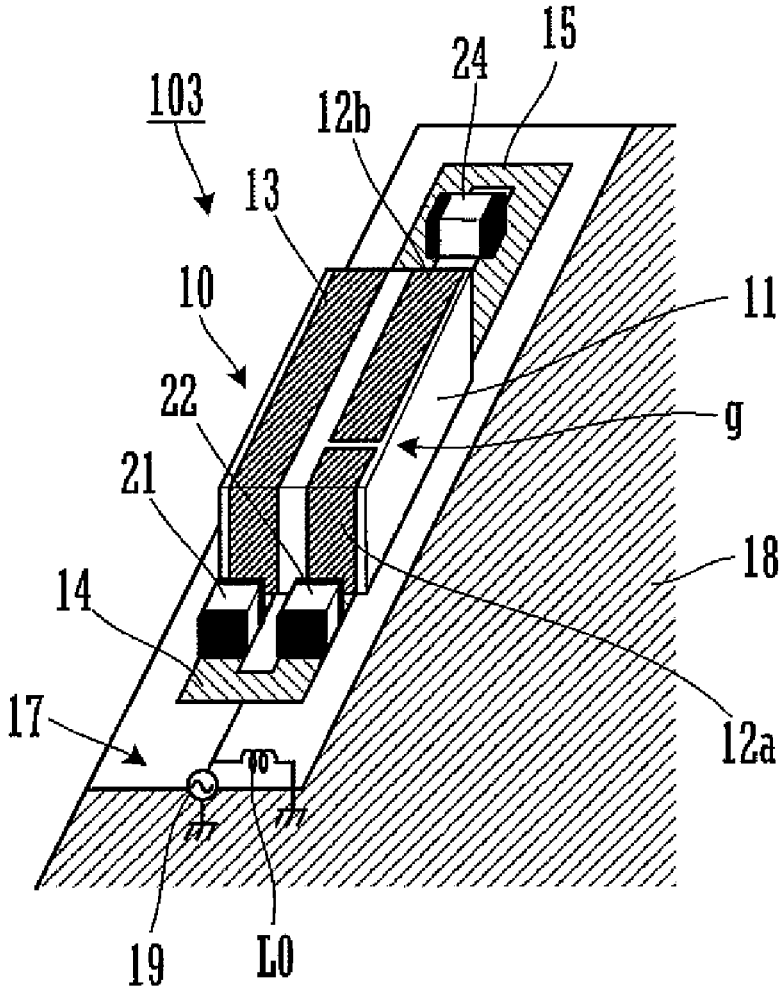
FIG. 8 is a perspective view of an antenna according to a third preferred embodiment of the present invention.

FIG. 8 is a perspective view of an antenna according to the third preferred embodiment. An antenna according to the third preferred embodiment differs from the antenna illustrated in FIG. 7 in the shape of the second radiation electrode 15 and the mounting method of a reactive element 24. That is, the second radiation electrode 15 preferably has a rectangular U-shape, and includes two linear electrode portions that are parallel or substantially parallel to each other. The reactive element 24 is disposed so that these linear electrode portions are connected to each other.

Figure 9A:
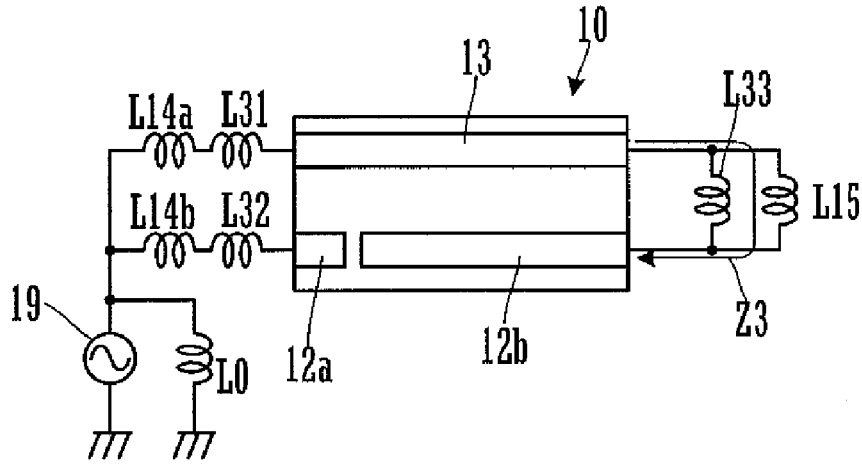
FIGS. 9A and 9B are circuit diagrams of an antenna according to the third preferred embodiment of the present invention.
Figure 9B:
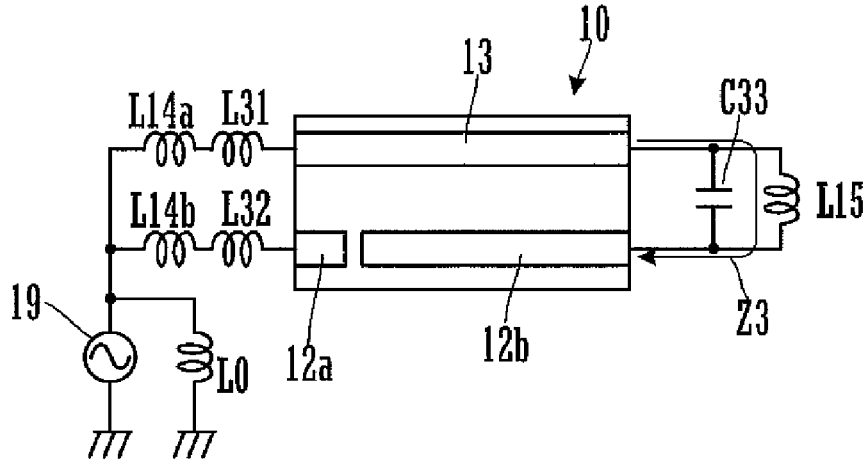

FIGS. 9A and 9B are circuit diagrams of an antenna 103 illustrated in FIG. 8. FIG. 9A illustrates an example in which the reactive elements 21, 22, and 24 are chip inductors. FIG. 9B illustrates an example in which the reactive elements 21 and 22 are chip inductors and the reactive element 24 is a chip capacitor.

Referring to FIGS. 9A and 9B, the inductors L14*a* and L14*b* are inductors of the first radiation electrode 14, and inductors L31 and L32 are inductors of the reactive elements (chip inductors) 21 and 23, respectively. The inductor L15 is an inductor of the second radiation electrode 15. Referring to FIG. 9A, an inductor L33 is an inductor of the reactive element (chip inductor) 24. Referring to FIG. 9B, a capacitor C33 is a capacitor of the reactive element (chip capacitor) 24.

As illustrated in FIG. 9A, by providing a parallel circuit including the inductors L15 and L33 at the path Z3, an inductance value at the path Z3 can be reduced and the resonance frequency f3 illustrated in FIG. 5 can be shifted to a higher frequency. As illustrated in FIG. 9B, by providing a parallel circuit including the capacitor C33 and the inductor L15 at the path Z3, a reactive component at the path Z3 can be controlled and the resonance frequency f3 can be shifted to a lower frequency. The reactive component at the path Z3 and the length of the path Z3 can be controlled by changing the mounting position of the reactive element 24 on the second radiation electrode 15 illustrated in FIG. 8.

Fourth Preferred Embodiment

Figure 10:
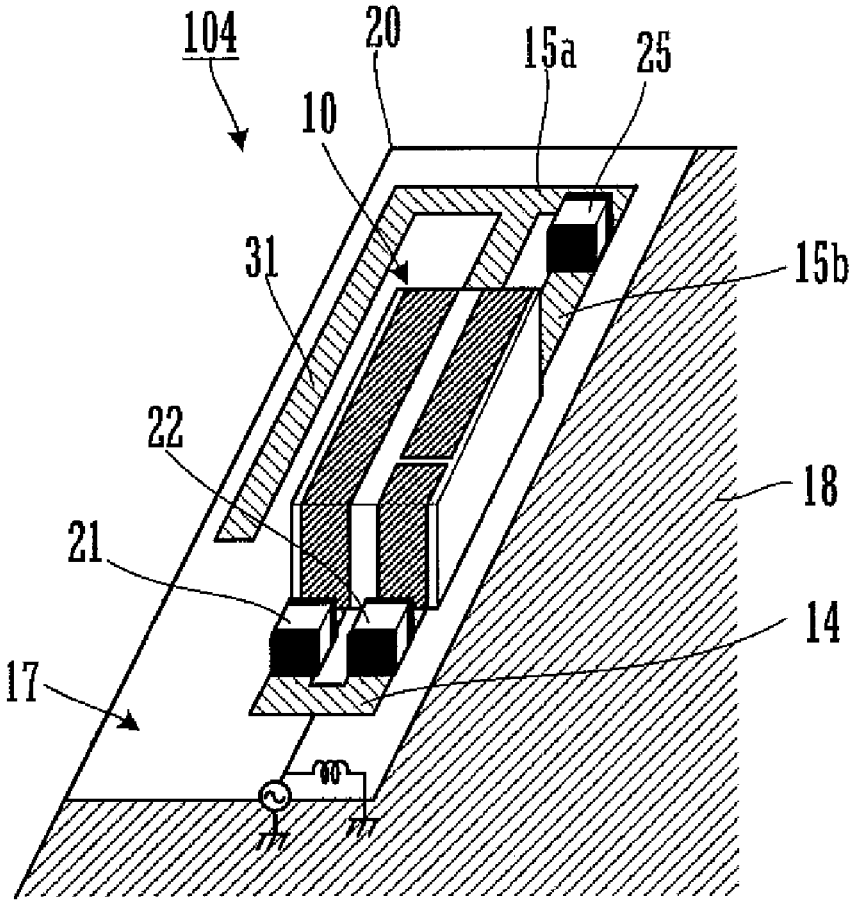
FIG. 10 is a perspective view of an antenna according to a fourth preferred embodiment of the present invention.

FIG. 10 is a perspective view of an antenna according to the fourth preferred embodiment. As illustrated in FIG. 10, an antenna 104 has a configuration in which the surface-mount antenna element 10 is located in the non-ground region 17 of the mount board 20. The configuration of the surface-mount antenna element 10 is preferably the same as that described previously in the first preferred embodiment with reference to FIG. 2.

In the non-ground region 17 of the mount board 20, the first radiation electrode 14 and the second radiation electrode 15, each of which has an inductor, are provided. The second radiation electrode 15 preferably includes the two linear electrode portions 15*a* and 15*b* that are parallel or substantially parallel to each other. An auxiliary electrode 31 branches off from the end of the linear electrode portion 15*a* and extends back toward the first radiation electrode 14.

The reactive elements 21 and 22 are disposed on the surface of the first radiation electrode 14 so that they are connected in series to the first radiation electrode 14.

A reactive element 25 is disposed on the surface of the linear electrode portion 15*b* so that it is connected in series to the linear electrode portion 15*b*.

Other components are the same as those included in the antenna 101 according to the first preferred embodiment. By disposing the auxiliary electrode 31, a radiation resistance is increased and antenna efficiency (in particular, the antenna efficiency of an antenna having the resonance frequency f3 that is affected by the linear electrode portions 15*a* and 15*b*) is improved.

Fifth Preferred Embodiment

Figure 11:
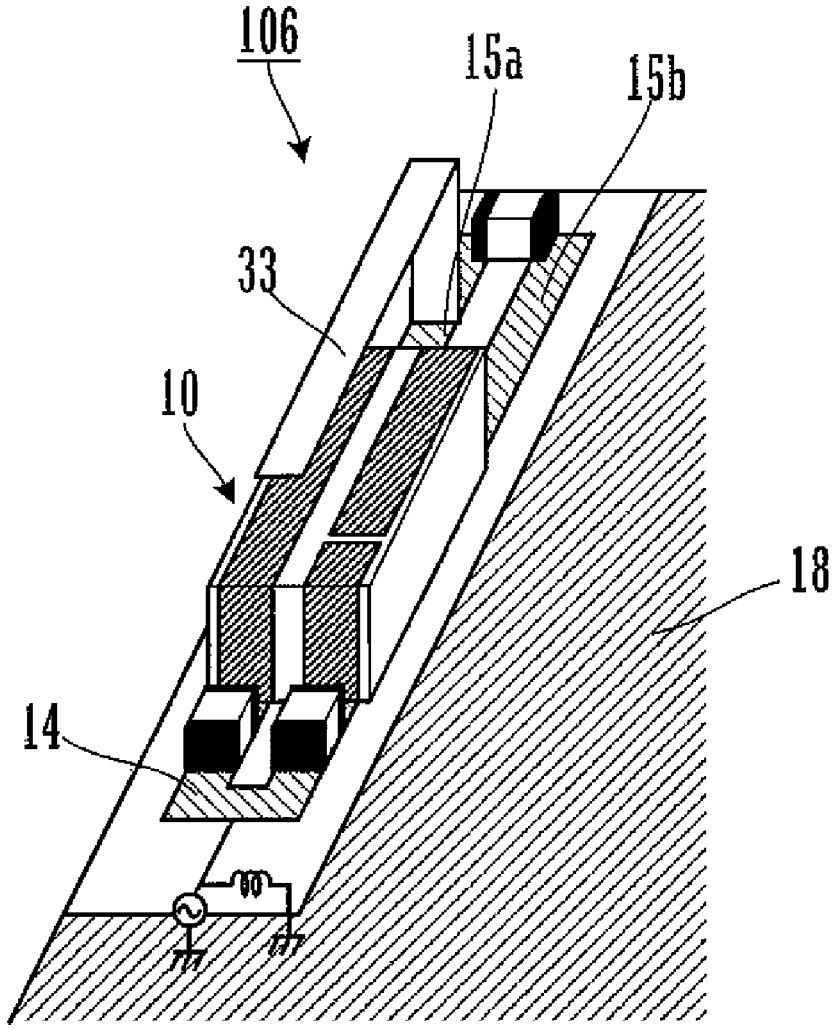
FIG. 11 is a perspective view of an antenna according to a fifth preferred embodiment of the present invention.

FIG. 11 is a perspective view of an antenna according to the fifth preferred embodiment. As illustrated in FIG. 11, an antenna 106 includes the two linear electrode portions 15*a* and 15*b* of the second radiation electrode. An L-shaped branch electrode plate 33 is disposed at the linear electrode portion 15*a*. That is, the branch electrode plate 33 is disposed in space so that one end of the branch electrode plate 33 is connected to the linear electrode portion 15*a* and the branch electrode plate 33 is bent back toward the first radiation electrode 14. Other components are preferably the same as those illustrated in FIG. 7. Thus, by disposing the branch electrode plate 33 at a radiation electrode, a radiation resistance is increased and antenna efficiency (in particular, the antenna efficiency of an antenna having the resonance frequency f3 that is affected by the linear electrode portions 15*a* and 15*b*) is improved.

Sixth Preferred Embodiment

Figure 12:
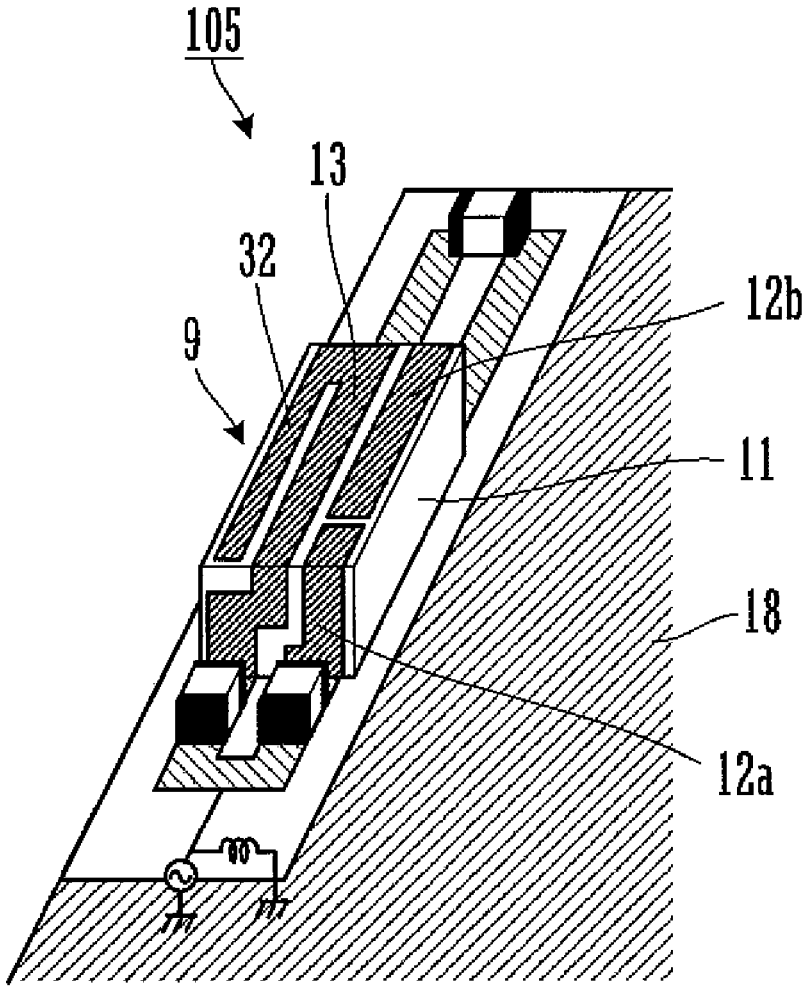
FIG. 12 is a perspective view of an antenna according to a sixth preferred embodiment of the present invention.

FIG. 12 is a perspective view of an antenna according to the sixth preferred embodiment. In this example, on the surface of the dielectric substrate 11, the linear electrodes 12*a*, 12*b*, and 13 and an auxiliary electrode 32 are provided. The auxiliary electrode 32 branches off from the linear electrode 13 and is bent back toward the feeding point. Other components are preferably the same as those illustrated in FIG. 7. By disposing an antenna element 9 including the auxiliary electrode 32, a radiation resistance is increased and antenna efficiency (in particular, the antenna efficiency of an antenna having the resonance frequency f3 that is affected by the linear electrode portions 15*a* and 15*b*) is improved.

Seventh Preferred Embodiment

Figure 13B:
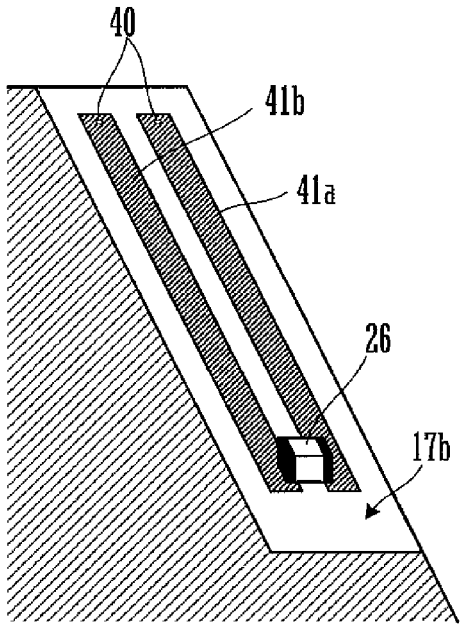
FIGS. 13A and 13B are perspective views of an antenna according to a seventh preferred embodiment of the present invention.
Figure 13A:
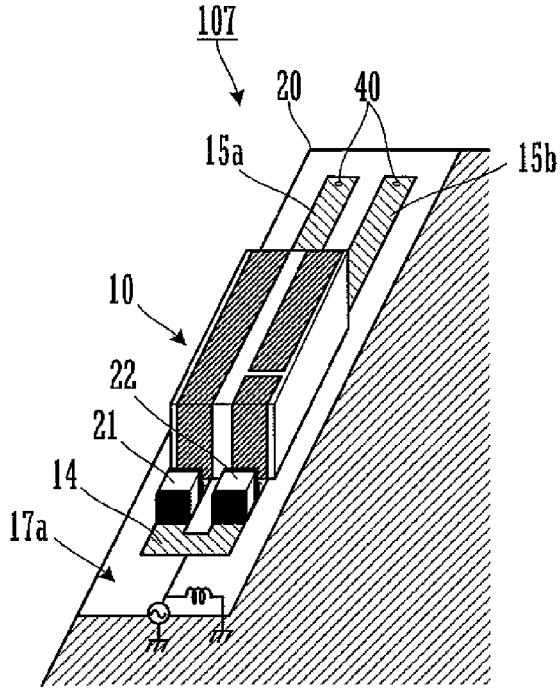

FIGS. 13A and 13B are perspective views of an antenna 107 according to the seventh preferred embodiment. FIG. 13A is a perspective view illustrating a surface on which the surface-mount antenna element 10 is disposed. FIG. 13B is a perspective view illustrating the undersurface thereof. In this example, the first radiation electrode 14 and the linear electrode portions 15*a* and 15*b* of the second radiation electrode are located in a non-ground region 17*a* on the surface of the mount board 20, and undersurface second radiation electrodes 41*a* and 41*b* are located in a non-ground region 17*b* on the undersurface of the mount board 20. The linear electrode portions 15*a* and 15*b* of the second radiation electrode on the surface of the mount board 20 are electrically connected through plated through holes 40 to the undersurface second radiation electrodes 41*a* and 41*b* on the undersurface of the mount board 20, respectively.

Furthermore, in this example, a reactive element 26 is used to connect the leading ends of the undersurface second radiation electrodes 41*a* and 41*b*.

As compared with an example in which the undersurface second radiation electrodes 41*a* and 41*b* are not disposed, the length of the path Z3 illustrated in FIGS. 9A and 9B can be increased, and the resonance frequencies f3 and f2 can be shifted to lower frequencies.

In the example illustrated in FIGS. 13A and 13B, by using a chip inductor as the reactive element 26 connected in series to the undersurface second radiation electrodes 41*a* and 41*b*, an inductance at the third path Z3 illustrated in FIG. 4 can be further increased, and the resonance frequencies f3 and f2 can be further shifted to lower frequencies.

Since the undersurface of the non-ground region of the mount board 20 can be effectively used, the increase in the area required for the antenna on the mount board 20 can be prevented.

Eighth Preferred Embodiment

Figure 14:
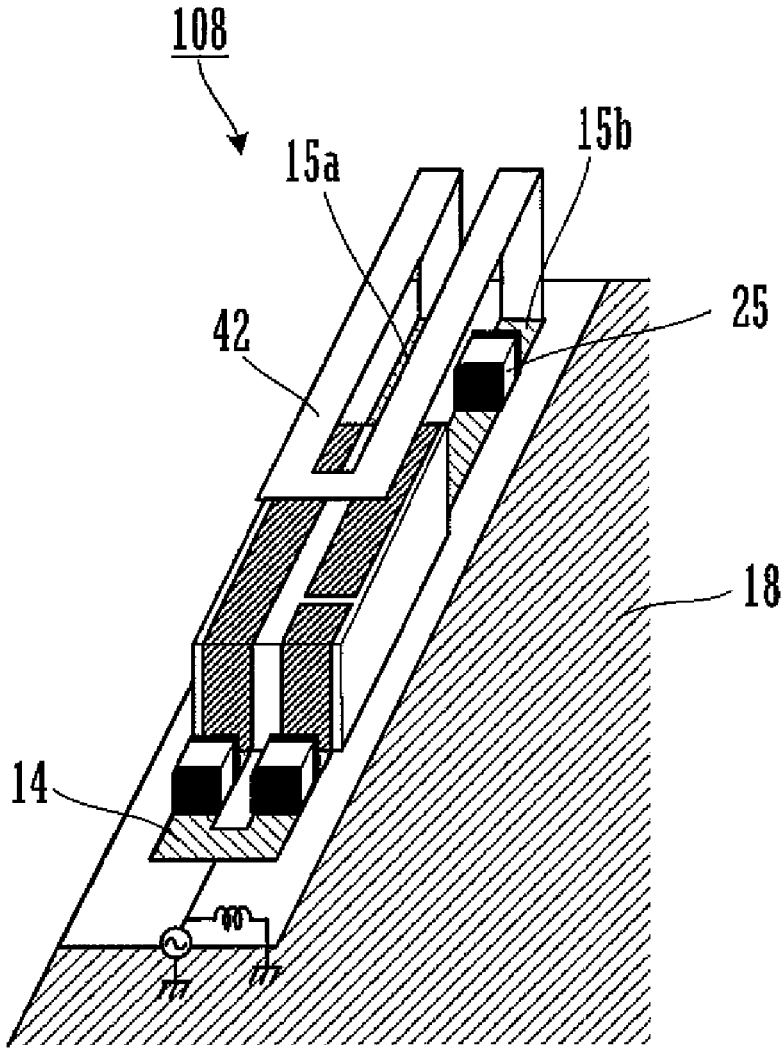
FIG. 14 is a perspective view of an antenna according to an eighth preferred embodiment of the present invention.

FIG. 14 is a perspective view of an antenna according to the eighth preferred embodiment. In this example, a radiation electrode plate 42 is used to connect in space the two linear electrode portions 15*a* and 15*b* of the second radiation electrode. That is, end portions of the radiation electrode plate 42 are connected to the linear electrode portions 15*a* and 15*b* of the second radiation electrode, respectively.

As compared with an example in which the radiation electrode plate 42 is not disposed, the length of the path Z3 illustrated in FIGS. 9A and 9B can be increased and the resonance frequencies f3 and f2 are shifted to lower frequencies.

Furthermore, since the radiation electrode plate 42 is bent back toward to the feeding point, the increase in the area (volume) required for an antenna 108 on the mount board can be prevented.

In the example illustrated in FIG. 14, the reactive element 25 is connected in series to the linear electrode portion 15*b* of the second radiation electrode. By using, for example, a chip inductor as the reactive element 25, an inductance at the third path Z3 illustrated in FIG. 4 can be further increased. The reactive element 25 may be disposed on the side of the linear electrode portion 15*a* of the second radiation electrode. In this case, a similar effect can be obtained.

Ninth Preferred Embodiment

Figure 15A:
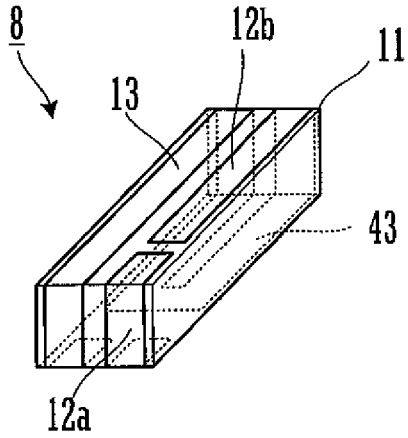
FIGS. 15A and 15B are perspective views of an antenna according to a ninth preferred embodiment of the present invention.
Figure 15B:
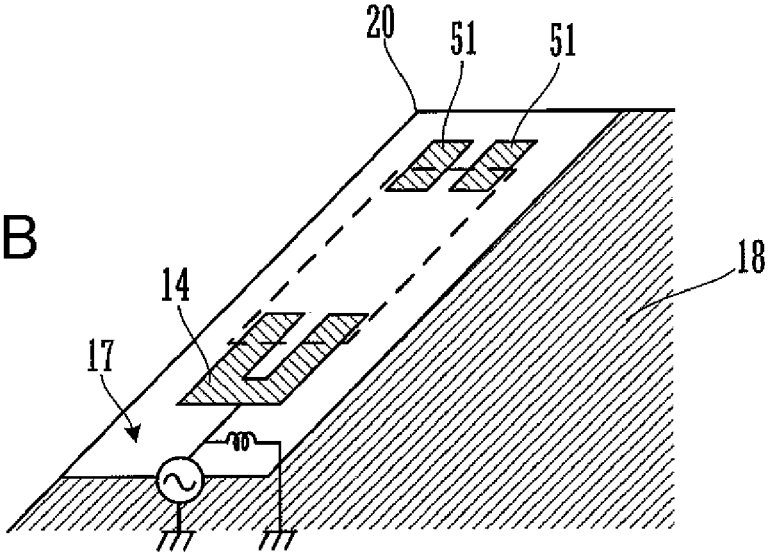

FIGS. 15A and 15B are partial perspective views of an antenna according to the ninth preferred embodiment. FIG. 15A is a perspective view of a surface-mount antenna element 8. FIG. 15B is a perspective view illustrating a configuration of a mount board on which the surface-mount antenna element 8 is disposed. As illustrated in FIG. 15A, the surface-mount antenna element 8 preferably includes the linear electrodes 12*a*, 12*b*, and 13 located on the surface of the dielectric substrate 11. On the lower surface of the dielectric substrate 11, a lower surface linear electrode extension formation portion 43 is provided. The linear electrodes 12*b* and 13 are connected through a rear end surface of the dielectric substrate 11 and the lower surface linear electrode extension formation portion 43 on the lower surface of the dielectric substrate 11.

The surface-mount antenna element 8 illustrated in FIG. 15A is disposed on the surfaces of the first radiation electrode 14 and mount electrodes 51 formed in the non-ground region 17 of the mount board 20 illustrated in FIG. 15B. A dashed line illustrated in the drawing represents a mounting position. End portions of the linear electrodes 12*a* and 13 are connected to the first radiation electrode 14, and a portion of the lower surface linear electrode extension formation portion 43 is connected to the mount electrode 51.

In the above-described configuration, the length of the path Z3 illustrated in FIG. 4 is increased and an inductance value at the path Z3 is therefore increased. Thus, it is possible to increase the length of the path Z3 and the inductance value at the path Z3 without disposing the second radiation electrode on the surface of the mount board.

Tenth Preferred Embodiment

Figure 16A:
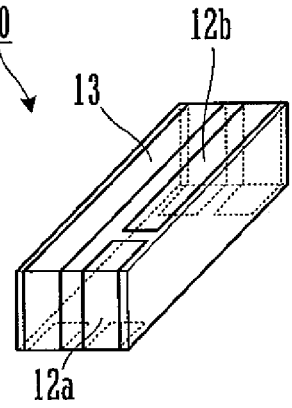
FIGS. 16A and 16B are perspective views of an antenna according to a tenth preferred embodiment of the present invention.
Figure 16B:
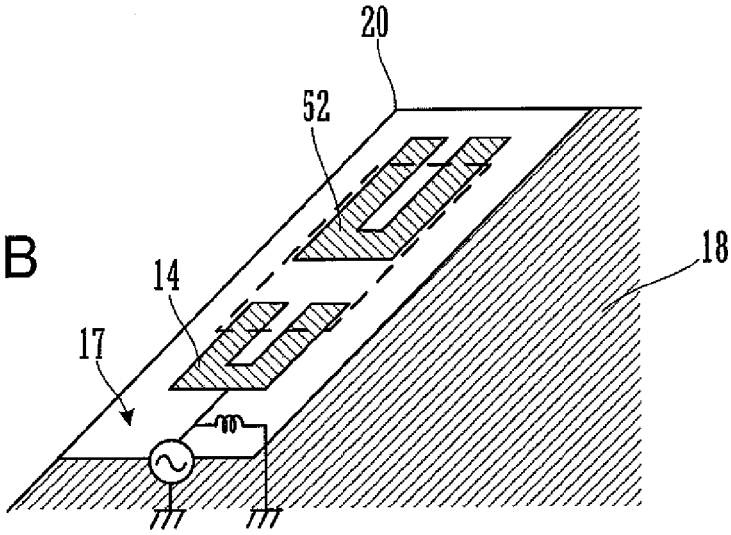

FIGS. 16A and 16B are perspective views of an antenna according to the tenth preferred embodiment. FIG. 16A is a perspective view of the surface-mount antenna element 10 located on a mount board. FIG. 16B is a perspective view of the mount board 20. In this example, the first radiation electrode 14 and a second radiation electrode 52 are located in the non-ground region 17 of the mount board 20. The second radiation electrode 52 differs from the second radiation electrode 15 illustrated in FIG. 2 in that it extends toward the mount region (region represented by a dashed line) of the surface-mount antenna element 10.

In the above-described configuration, the non-ground region 17 of the mount board 20 can be reduced, and an area required for an antenna on the mount board 20 can therefore be reduced.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna comprising:

a mount board having a non-ground region; and a surface-mount antenna element disposed in the non-ground region; wherein the surface-mount antenna element includes at least two linear electrodes that are parallel or substantially parallel to each other on a surface of a substrate, and at least one capacitor arranged such that portions of at least one of the two linear electrodes face each other with a predetermined distance therebetween;

the non-ground region of the mount board includes radiation electrodes that are individually connected to the two linear electrodes to define inductors, and one of the radiation electrodes includes a feeding point; and the two linear electrodes of the surface-mount antenna element, the capacitor, and the radiation electrodes define a parallel resonance circuit.

2. The antenna according to claim 1, further comprising chip reactive elements individually connected in series to the radiation electrodes in the non-ground region of the mount board.

3. The antenna according to claim 1, wherein each of the radiation electrodes includes two linear electrode portions that are parallel or substantially parallel to each other, and a chip reactive element is arranged to connect predetermined positions of the two linear electrode portions in the non-ground region of the mount board.

4. The antenna according to claim 1, wherein the radiation electrodes include a first radiation electrode connected to first ends of the two linear electrodes of the surface-mount antenna element and a second radiation electrode connected to second ends of the two linear electrodes of the surface-mount antenna, and the first radiation electrode includes the feeding point.

5. The antenna according to claim 4, further comprising chip reactive elements which are individually connected to the first radiation electrode and the second radiation electrode.

6. The antenna according to claim 4, further comprising an auxiliary electrode arranged to branch off from the second radiation electrode and extend in the non-ground region of the mount board.

7. The antenna according to claim 4, wherein one end of a branch electrode plate is connected to the second radiation electrode.

8. The antenna according to claim 1, further comprising an auxiliary electrode which branches off and extends from one of the two linear electrodes of the surface-mount antenna element.

9. The antenna according to claim 1, wherein portions of the radiation electrodes are disposed on an undersurface of the mount board on which the surface-mount antenna element is disposed.

10. The antenna according to claim 1, wherein each of the radiation electrodes includes two linear electrode portions that are parallel or substantially parallel to each other, and a radiation electrode plate is arranged to connect the two linear electrode portions in space.

11. The antenna according to claim 1, wherein one of the radiation electrodes is connected to first ends of the two linear electrodes of the surface-mount antenna element, and the other one of the radiation electrodes is arranged to extend to second ends of the two linear electrodes of the surface-mount antenna element from an upper surface of the surface-mount antenna element to a lower surface of the surface-mount antenna element.

12. A radio communication apparatus comprising:

the antenna according to claim 1; and a radio communication circuit provided on the mount board.

* * * * *